US005440967A

United States Patent [19]

Wennerbo

[11] Patent Number: 5,440,967

[45] Date of Patent: Aug. 15, 1995

[54] METHOD FOR CONTROLLING A HYDRAULIC MOTOR AND A HYDRAULIC VALVE THEREFOR

[75] Inventor: Örjan Wennerbo, Borås, Sweden

[73] Assignee: Voac Hydraulics Boras AB, Boras, Sweden

[21] Appl. No.: 179,050

[22] Filed: Jan. 7, 1994

[30] Foreign Application Priority Data

Jan. 14, 1993 [SE] Sweden ..... 93000842

[51] Int. Cl.[6] ..... F15B 13/02

[52] U.S. Cl. ..... 91/471; 60/452; 91/446; 91/451; 137/596; 137/596.13

[58] Field of Search ..... 60/452; 91/446, 451, 91/471; 137/596, 596.13

[56] References Cited

U.S. PATENT DOCUMENTS 5,129,229 7/1992 Nakamura et al. ..... 137/596.13 X

*Primary Examiner*—Gerald A. Michalsky
*Attorney, Agent, or Firm*—Young & Thompson

[57] ABSTRACT

A method for controlling a hydraulic motor with a hydraulic valve comprising an inlet section which includes a pump and tank connection and a maneuvering section having a slide (B1) and a load signal system (L1, L2, L3). The hydraulic valve also includes two regulating constrictions (S3, S4) which can be connected to and from a motor (C), such as a hydraulic piston-cylinder device. The maneuvering slide (B1) also includes a load level detecting constriction (S2) and a load signal drain (S5), and the pump generates an idling pressure. When maneuvering the maneuver slide (B1), the load signal Ps of the load signal system is increased by a further constriction (S1) located between the pump connection and that side of the load detecting constriction (S2) that has the higher pressure during the maneuvering process.

16 Claims, 4 Drawing Sheets

METHOD FOR CONTROLLING A HYDRAULIC MOTOR AND A HYDRAULIC VALVE THEREFOR

The present invention relates to a method for controlling hydraulic motors and to a hydraulic valve therefor.

1. Field of the Invention

More specifically, the invention relates to the control of a hydraulic so-called closed centre valve (CFC-valve) or of a hydraulic so-called load sensing valve (LS-valve).

2. Background of the Invention

The invention will be described in the following mainly with reference to a CFC-valve, although it will be understood that appropriate parts of the description are also applicable to an LS-valve.

A so-called CFC-valve is constructed for use in systems together with a fixed displacement pump, i.e. a pump which delivers a constant flow of medium at a given pump speed. In principle, the valve operates to detect the highest pressure out to activated functions and the pump pressure is then adjusted so as to be slightly higher than the value of the detected load signal. The pressure difference is used to drive oil through the valve and out to the motor, for instance a hydraulic cylinder, wherein the greater the pressure difference, the higher the valve capacity.

A CFC-valve will normally include an inlet part which provides a shunt function, and one or more manoeuvering sections which include slides and possibly also compensators which regulate the speed of motors connected thereto, for instance the operating speed of piston-cylinder devices.

The shunt has two main functions. The first of these functions is to adjust the pump pressure to current requirements. The other is to bypass surplus oil to a tank. All oil is shunted to a tank when no function is activated.

When all oil is shunted to a tank, it is desirable to shunt the oil at the lowest possible pressure drop, since the power losses occurring when pumping oil around the system are directly proportional to the pressure.

On the other hand, when carrying manoeuvering work, it is desirable that the shunt-regulated pressure level is higher than the idling level, since a higher pressure will result in greater flow. A low level means that the valve must be made larger, with the additional cost entailed thereby, so as to provide the same flow rate as a valve which operates at larger pressure differences.

The problem is that a low pressure difference is desired during idling conditions, whereas a high pressure difference is desired when the motor carries out manoeuvering work.

SUMMARY OF THE INVENTION

The present invention solves this problem and provides a method and an arrangement which provide a low pressure difference in idling conditions and a higher pressure difference in manoeuvering conditions.

In the main, an LS-valve operates similarly to a CFC-valve. The difference between the valves is that in the case of an LS-valve, the shunt is replaced with a variable displacement pump and a regulator which controls displacement of the pump so as to obtain a constant pressure difference between pump pressure and load signal.

The problem with an LS-valve is that when a function requires a greater flow of working medium, it is normally necessary to increase the dimensions of the valve as a whole.

This problem is solved by the present invention in that one or more functions, i.e. one or more motors, supplied by one and the same pump can be readily given a higher capacity without influencing the valve in general.

Thus, the present invention relates to a method for controlling a hydraulic motor by means of a valve of the kind which comprises an inlet section including a pump and tank connection and a manoeuvering section which includes a slide, and a load signalling system, and which further includes two regulating constrictions for each movement direction, said constrictions being connectable to and from a motor, such as a hydraulic piston-cylinder device, wherein the manoeuvering slide also includes a load level sensing constriction and a load signal drain, and wherein said pump produces an idling pressure, said method being characterized in that when manoeuvering by means of the manoeuvering slide, the load signal of the load signal system is increased by means of a further constriction located between the incoming pump connection and that side of the load sensing constriction which has the higher pressure when manoeuvering.

The invention also relates to a hydraulic valve comprising an inlet section which includes a pump and tank connection and a manoeuvering section including a slide, and a load signal system. The valve further includes two regulating constrictions for each movement direction. The constrictions are connectable to and from a motor, such as a hydraulic piston-cylinder device. The manoeuvering slide also includes a load level detecting constriction and a load signal drain, and the pump generates an idling pressure. An additional constriction is provided between the pump connection and that side of the load detecting constriction which has the higher pressure in a manoeuvering process. The additional constriction is intended to increase the load signal Ps of the load signal system when manoeuvering with the manoeuvering slide.

BRIEF DESCRIPTION OF THE DRAWINGS

The invention will now be described in more detail, partially with reference to exemplifying embodiments of the invention illustrated in the accompanying drawings, in which.

DETAILED DESCRIPTION OF THE INVENTION

Figure 1:
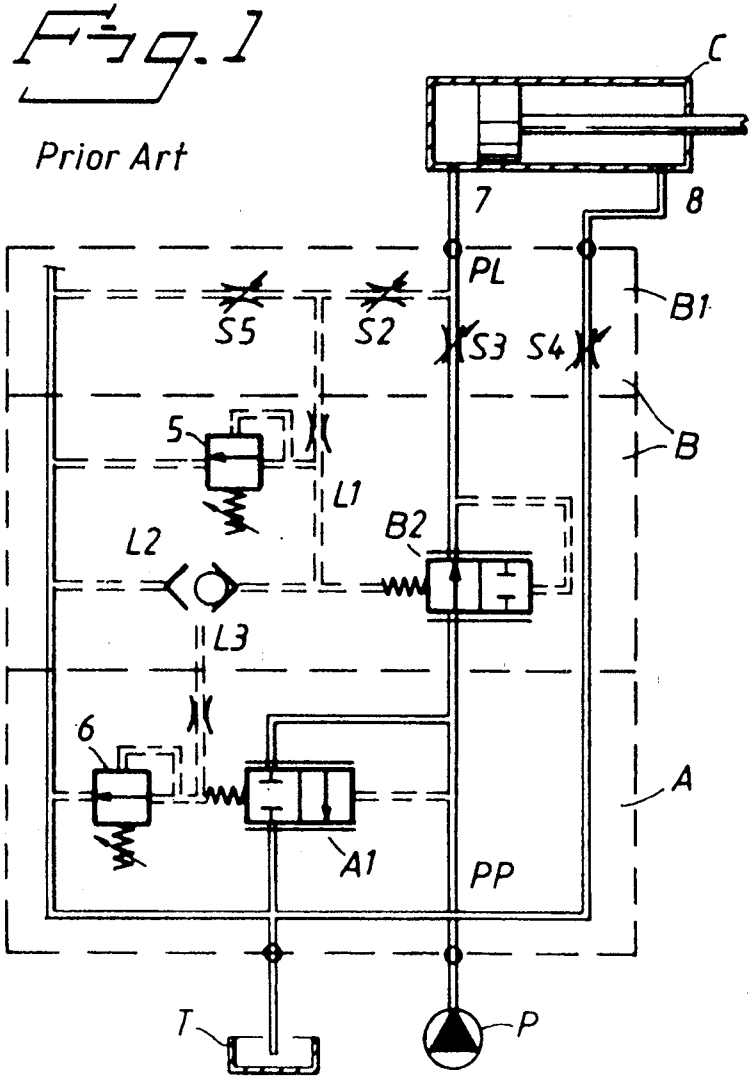
Fig. 1 Prior Art
FIG. 1 illustrates a hydraulic circuit for a known CFC-valve.

FIG. 1 illustrates a known CFC-valve. The reference letter A identifies an inlet section which includes a pump P and a tank connection T. Reference A1 identifies a shunt valve which includes a spring-biassed shunt slide. The desired pressure drop across the shunt valve is set by means of the spring force in idling conditions. The reference letter B identifies a manoeuvering section which includes a slide B1 and a compensator B2 and a load signal system referenced L1, L2 and L3.

In addition to two regulating constrictions referenced S3 and S4, which are connectable to and from a motor C, the slide B1 also includes a load level sensing constriction S2 and a load signal drain S5.

The circuit also includes a pressure-limiting valve 5 which opens at a motor pressure which exceeds a set maximum pressure. The reference numeral 6 identifies a pressure-limiting valve which functions to protect the system illustrated in FIG. 1. Both valves 5 and 6 are connected to the tank T.

When the slide B1 occupies its neutral position, the restrictions S2, S3 and S4 are closed and the drain S5 is open. The load signal line L1 is thus drained into the tank through the drain S5. The spring side of the shunt A1 is also drained into the tank, through a reversing valve L2 and the load signal channel L3. With the slide B1 in this position, the pump flow is shunted to the tank via the shunt slide of the shunt valve A1 with a pressure drop which is determined essentially by the spring force acting on the shunt slide.

As the main slide B1 is moved slightly from its neutral position, the drain or constriction S5 is closed while the constriction S2 opens. The load pressure PL in the motor port is herewith transferred to the spring side of the shunt slide via the load signal system L1, L2 and L3. In order to maintain the force balance across the shunt slide and to prevent the shunt valve closing, the pump pressure is increased by a value which corresponds to the load pressure PL in the motor port.

Upon further activation of the main slide B1, the constrictions S3 and S4 begin to open. In addition to being delivered to the shunt slide, the load signal PL is also delivered to the slide of the compensator B2. As a result of the force balance that now acts across the compensator, the difference between the pressure upstream of S3, i.e. on the right side of the compensator slide in FIG. 1, and the pressure downstream of S3, i.e. the pressure on the spring side of the compensator slide, will be proportional to the spring force acting on the compensator slide.

The compensator will produce an essentially constant pressure difference across the constriction S3 irrespective of the load PL. The shunt valve will produce a slightly higher pressure difference between pump connection and motor port.

As a result of the constant pressure difference across S3, the flow through S3 will be independent of the load pressure PL and will vary solely with the position of the slide B1.

In order to be able to achieve a flow which is sufficient to produce a desired maximum rate with a valve of reasonable size, it is normally necessary to produce a shunt-valve controlled pressure level which is higher than what is desirable as an idling pressure drop.

An LS-valve operates in the same manner as that described with regard to the CFC-valve, although the load signal to the shunt is instead delivered to a pump regulator which controls the displacement of the pump.

For the sake of clarity, all hydraulic diagrams show a function which operates in one direction.

The subject matter described hitherto forms part of the known prior art.

Figure 2:
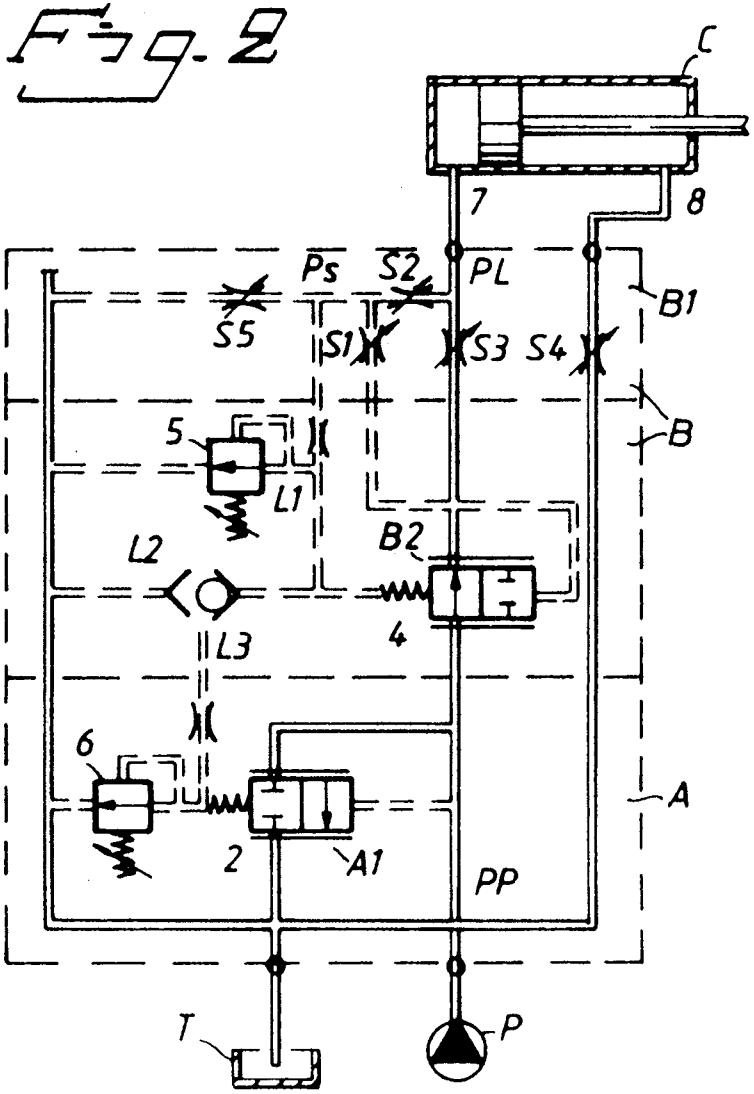
FIG. 2 illustrates a hydraulic circuit for an inventive CFC-valve.

According to the present invention, the problem recited in the introduction is solved by including an additional constriction S1 in the circuit, see FIG. 2. FIG. 2 is a similar illustration to FIG. 1 but with the difference that the constriction S1 has been introduced. Consequently, the reference signs used in FIG. 2 are the same as those used in FIG. 1.

In accordance with the invention, when manoeuvering by means of the manoeuver slide B1 the load signal Ps of the load signal system is increased by means of the additional constriction S1 located between the pump connection and that side of the load detecting constriction S2 which has the higher pressure during a manoeuvering process.

The invention will be exemplified below with reference to the circuit illustrated in FIG. 2.

The circuit shown in FIG. 2 operates in the following manner.

When the slide B1 occupies its neutral position, the constrictions S1, S2, S3 and S4 are closed and the constriction S5 is open. The pressure Ps is thus drained through S5 into the tank. This means that in this operational state of the circuit, the shunt valve produces a pressure Pp which is equal to Pfj, where Pfj is the pressure generated by the shunt valve spring 2.

When the slide B1 is activated, the constriction S5 is closed. The constrictions S1, S2, S3 and S4 are then opened. The compensator will herewith maintain a constant pressure difference across the constriction S1. This pressure difference is determined by the compensator spring 4 and a constant flow will therefore be obtained through S1.

Provided that the pressure-limiting valves 5 and 6 do not open, the pressure compensated flow through S1 is forced to flow through S2 and into the motor port 7. A pressure drop Ps2 is therewith obtained through S2. As a result, the signal, or the pressure, Ps to the compensator and the shunt valve will be equal to PL+Ps2. The pump pressure Pp will therefore be equal to PL+Ps2+Pfj, where Pfj is the pressure difference generated by the shunt valve spring 2.

The principle employed by the invention is thus that the load signal includes a pressure part, namely PL from the motor port, which is increased by pressure emanating from the pump side.

Thus, the present invention enables the idling pressure drop to be low and equal to Pfj, while when manoeuvering the active pressure difference becomes high, namely Pfj has increased by Ps2. The problem recited in the introduction is therewith solved.

According to one preferred embodiment of the invention, the additional constriction S1 is constructed so that it will open further as activation of the manoeuvering slide B1 increases. This provides the added advantage of enabling the pressure difference to be maintained at a relatively low level at low motor speeds during a manoeuvering operation and to increase at increasing flow rates.

Although the present invention has been described above with reference to an exemplifying embodiment in which a CFC-valve is used and which also includes a compensator, it will be understood that the invention can also be applied in the absence of a compensator and that the invention is not therefore restricted to the use of valves that include a compensator. However, it is often preferred to provide the valve with a compensator.

Neither is the invention restricted to a construction that includes a CFC-valve. For instance, the CFC-valve may be replaced with an LS-valve.

Figure 6:
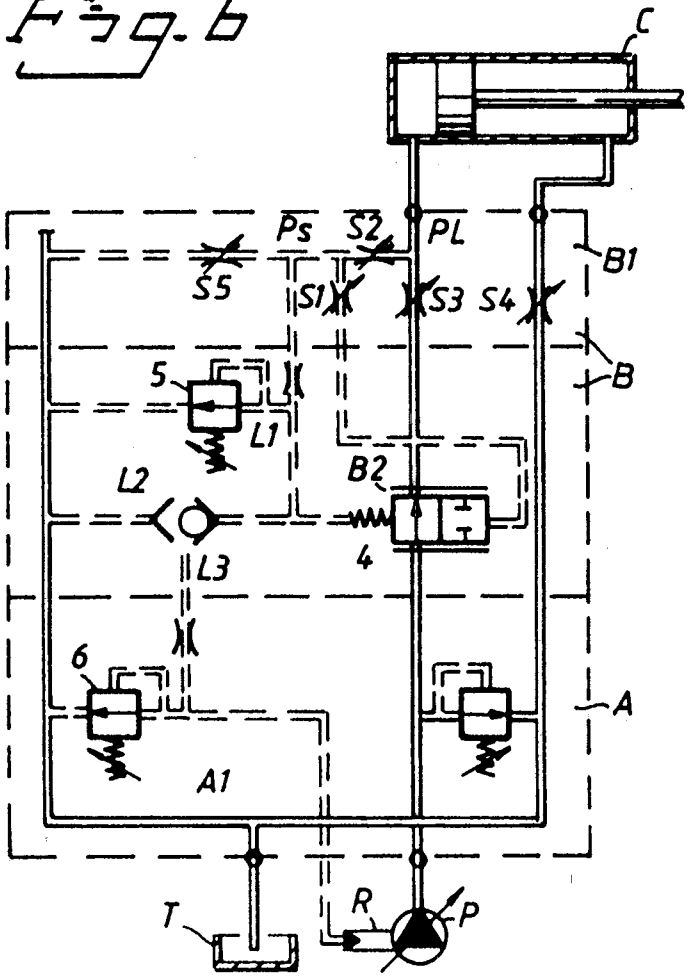
FIG. 6 illustrates a hydraulic circuit corresponding to the circuit in FIG. 2, but with the use of a so-called LS-valve.

FIG. 6 illustrates a hydraulic circuit in which the CFC-valve has been replaced with an LS-valve. The shunt is omitted when an LS-valve is used. Instead of shunting excess oil to the tank, the circuit includes a regulator R which is intended to control the displacement of the pump P in a manner to adapt the pump flow to the instantaneous requirement of the system.

In this case, the load signal is delivered to the regulator R, instead of to the shunt. The circuit illustrated in FIG. 6 corresponds to the circuit illustrated in FIG. 2 in other respects and it is therefore not necessary to describe FIG. 6 in closer detail.

The present invention also provides an important advantage when performing several functions at one and the same time in the absence of a compensator. CFC-valves and LS-valves which lack a compensator will normally have very poor multi-operation properties. When performing several operations at one and the same time, all of the functions are connected on the delivery line from the pump. The heaviest load is pressure-compensated by the shunt valve or the pump, whereas the remaining loads lack pressure compensation. If there is first started a light load function which is followed by a further function that has a much heavier load, the pressure drop for the first function is changed from the pressure drop regulated by the shunt valve or the pump, this pressure drop often being in the order of 15 bars, to a pressure of 200 bars for instance, depending on the heavier load. This results in an increase in flow rate of 300%.

By providing an additional restriction S1 for one or more functions, i.e. for one or more motors that are supplied by one and the same pump, a pressure difference of, for instance, 50–60 bars or higher can be chosen for lighter loads, through the medium of the additional constriction S1. This results in greatly reduced disturbance from the heavier load.

Figure 7:
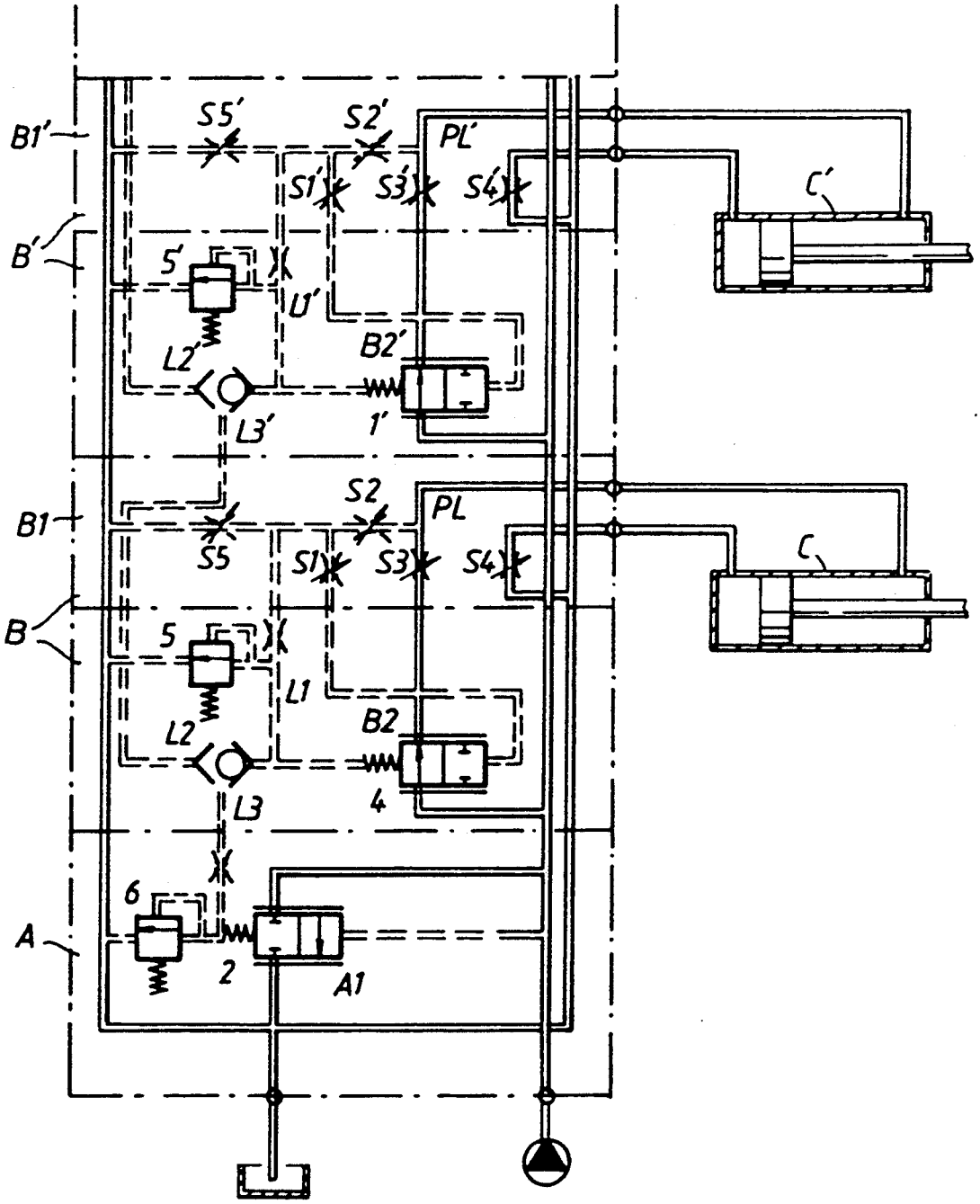
FIG. 7 illustrates a hydraulic circuit which includes two motors.

FIG. 7 illustrates a case in which two motors C, C' are connected to one and the same pump circuit. The units A, B and B1 have been identified in FIG. 6 by the same reference signs as those used in FIG. 2. The reference signs B' and B1' identify the manoeuvering section for the second C of the motors C, C'. The components present in the manoeuvering section B1, B1' have been identified by the same reference signs as those used to identify the components in the manoeuvering section B, B1. Thus, FIG.7 illustrates an inlet section and two manoeuvering sections having the functions required for manoeuvering in one direction. Correspondingly, additional functions may conceivably be connected above the uppermost manoeuvering section.

Manoeuvering sections with or without the additional constriction S1 and with or without a compensator can be mixed freely to provide each function with those particular properties judged to be optimal.

An LS-valve is built-up in a corresponding manner, in which the shunt valve is omitted and replaced with a load signal output to a variable displacement pump.

Figure 3:
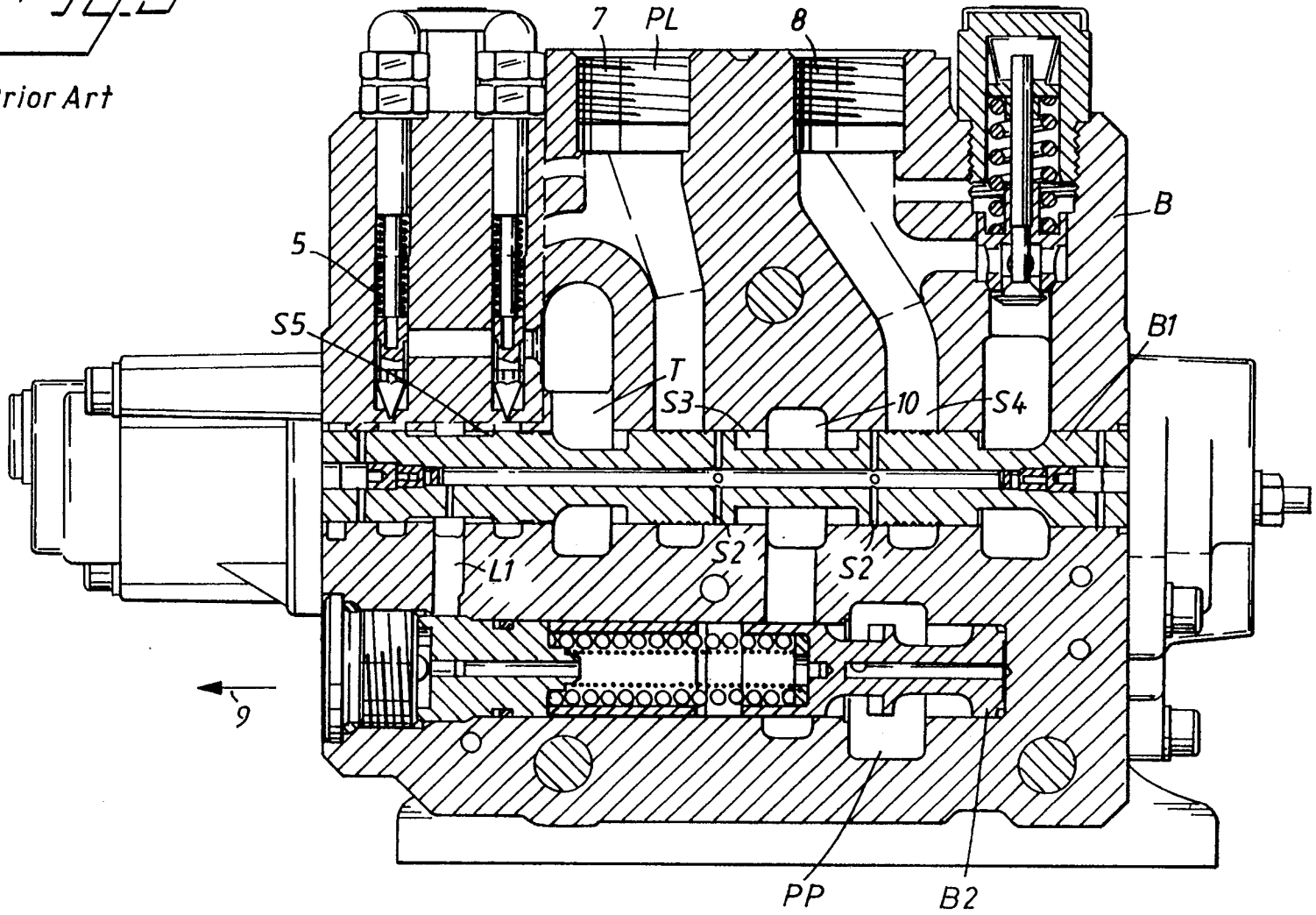
FIG. 3 Prior Art
FIG. 3 is a cross-sectional view of one embodiment of a known CFC-valve.

FIG. 3 illustrates an example of a known type of CFC-valve or LS-valve. The valve components have been identified in FIG. 3 by the same reference signs as those used in FIG. 1. When the slide B1 is moved in the direction of arrow 9, S5 will close the connection to the tank channel T. In addition, the left-hand channel of the channels S2, namely the constriction S2, will open a connection to the motor port 7 and S4 is opened to the return line 8 from the motor. When the slide B1 is moved further in the direction of arrow 9, S3 is opened to the motor port. The reference numeral 10 identifies the pump channel downstream of the compensator B2. The right-hand constriction S2 is activated when the slide B1 is moved in a direction opposite to the arrow 9.

Figure 4:
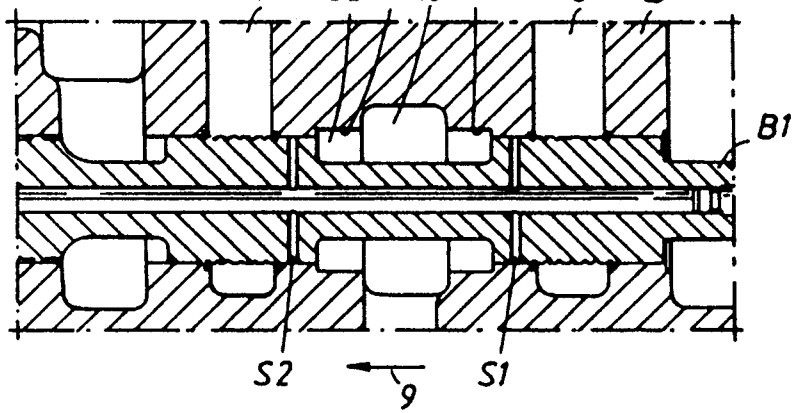
FIG. 4 illustrates a central part of the valve shown in FIG. 3 modified in accordance with a first embodiment of the invention.

FIG. 4 illustrates a first inventive embodiment of a valve illustrated in FIG. 3. FIG. 4 shows only the central part of the slide B1. The modification that has been made to the valve illustrated in FIG. 3 is that the housing B has been provided with a circumferentially extending recess 11 on both sides of the pump channel 10. As a result of this recess, the channel S1 in FIG. 4 will be connected with the pump channel 10 as the slide is moved in the direction of the arrow 9, and the channel S1 will therefore function as the constriction S1. When the slide is moved in the other direction, the constriction referenced S1 in FIG. 4 will function as the restriction S2, whereas the restriction S2 in FIG. 4 will function as the restriction S1. The two constrictions S1 and S2 are identical in this construction.

Figure 5:
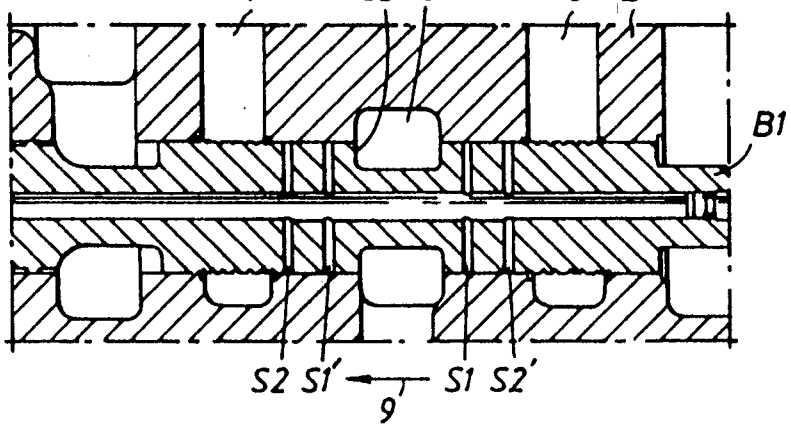
FIG. 5 illustrates a central part of the valve shown in FIG. 3 modified in accordance with a second embodiment of the invention.

FIG. 5 illustrates another embodiment, in which the slide B1 is provided with two further channels S1 and S1' instead of recesses 11. The channel S1 functions as the constriction S1 when the slide is moved in the direction of the arrow 9, and the channel S1' functions as the constriction S1 when the slide is moved in the opposite direction. When the slide is moved in the direction of arrow 9, S2 will connect with the channel 7, i.e. the motor port, and the constriction S1 will come into contact with the pump channel 10. The constrictions S2' and S1' have a corresponding function when the slide is moved in the opposite direction.

Thus, in the case of this embodiment, the constrictions S1, S2 and S1' and S2' respectively can be chosen independently of one another. For instance, the constrictions S1 and S1' may have a greater area than the constrictions S2 and S2' so as to increase the pressure Ps to compensator and shunt valve. The ratio of S1/S2 to S1'/S2' may thus be chosen freely.

As will be evident from the aforegoing, the flow of medium to the motor is determined by the area of the constriction S3 and the pressure drop across said constriction. The higher the pressure drop, the greater the flow. The pressure drop across S3 is equal to the sum of the pressure drops across the constrictions S1 and S2.

If the valves 5 and 6 are closed, the same flow is obtained through constrictions S1 and S2. The pressure drop across S1 is determined by the compensator B2, or by the shunt A1 when no compensator is present. In the case of an LS-valve which lacks a compensator, the pressure drop across S1 is determined by the pump.

When S1 has the same area as S2, the pressure drop across S3 will thus be equal to twice the compensator pressure difference. If the area in S2 is decreased, the same flow will still be forced through S2, thereby causing the pressure drop across S2 to increase.

For instance, if the area of S1 is equal to twice the area of S2, the pressure drop across S2 will be equal to four times the pressure drop across S1, and the pressure drop across S3 will then be equal to five times the compensator pressure difference. The flow will therefore be more than twice as large as would have been the case with the same valve which lacked the constriction S1.

The pressure difference across S3 can be chosen at a desired level, by reducing the area of S2 and/or increasing the area of S1. The maximum level is determined by the valves 5 and 6.

It is therefore evident that the areas of S1 and S2 can be chosen by the skilled person to achieve a desired effect in accordance with the application for which the hydraulic valve is used.

It can be maintained that relatively small and narrow valves can be enabled to operate at much greater flows than is possible with a conventional load signal system, by including a further constriction S1 on a valve slide.

Although the invention has been described above with reference to a number of embodiments thereof, it will be understood that other embodiments are conceivable in addition to those exemplified.

The present invention shall not therefore be considered restricted to the aforedescribed and illustrated exemplifying embodiments thereof, since modifications can be made within the scope of the following claims.

I claim:

1. In a method for controlling a hydraulic motor with the aid of a valve which comprises an inlet section that includes a pump and tank connection and a manoeuvering section having a slide (B1), and a load signal system (L1, L2, L3), and further comprises two regulating constrictions (S3, S4) for each movement direction, wherein said constrictions can be connected to and from a motor (7), wherein the manoeuvering slide (B1) also includes a load level detecting constriction (S2) and a load signal drain (S5), and wherein said pump generates an idling pressure, the improvement wherein when manoeuvering by means of the manoeuvering slide (B1), the load signal Ps of the load signal system is increased by means of an additional constriction (S1) located between the pump connection and that side of the load detecting constriction (S2) which has the higher pressure in the manoeuvering process.

2. A method according to claim 1, which comprises using a CFC-valve, having a shunt valve (A1) which includes a spring-biassed shunt slide by means of which the desired idling pressure drop across the shunt valve is set, said pressure-biassed shunt slide controlling said idling pressure Pfj; and said load signal is delivered to the shunt slide.

3. A method according to claim 1, which comprises using an LS-valve having a variable displacement pump (P) which is controlled by a regulator (R); and delivering said load signal to the regulator (R).

4. A method according to claim 1, wherein a compensator (B2) is connected between the inlet section (A) and the main slide (B1) of the valve.

5. A method according to claim 4, which comprises using a closed centre valve (CFC-valve), wherein the additional constriction (S1) is connected in a valve supply channel downstream of the compensator (B2).

6. A method according to claim 1, wherein the load signal is increased from 1.5 to 50 times.

7. A method according to claim 1, wherein the additional constriction (S1) is a variable constriction so as to open to a greater extent in response to increasing movement of the manoeuvering slide (B1).

8. A method according to claim 1, wherein the load detecting constriction (S2) and the additional constriction (S1) have mutually different throttling effects.

9. In a hydraulic valve comprising an inlet section which includes a pump and tank connection and a manoeuvering section including a slide (B1), and a load signal system (L1, L2, L3), and which valve further includes two regulating constrictions (S3, S4) for each movement direction, said constrictions being connectable to and from a motor (C), and wherein the manoeuvering slide (B1) also includes a load level detecting constriction (S2) and a load signal drain (S5), and wherein said pump generates an idling pressure, the improvement wherein an additional constriction (S1) is provided between the pump connection and that side of the load detecting constriction (S2) which has the higher pressure in a manoeuvering process, and said additional constriction being intended to increase the load signal Ps of the load signal system when manoeuvering by means of the manoeuvering slide (B1).

10. A valve according to claim 9, which includes a CFC-valve having a shunt valve (A1) comprising a spring-biassed shunt slide which functions to set the desired idling pressure drop across the shunt valve, said spring-biassed shunt slide controlling the idling pressure Pfj; and said load signal being connected to the shunt slide.

11. A valve according to claim 9, which includes an LS-valve having a variable displacement pump (P) which is controlled by a regulator (R); and the load signal being connected to the regulator (R).

12. A valve according to claim 9, further including a compensator (B2) which is connected between the inlet section (A) and the main slide (B1) of the valve.

13. A valve according to claim 12, wherein when a closed centre valve (CFC-valve) is used, the additional constriction (S1) is connected to the valve supply channel downstream of the compensator (B2).

14. A valve according to claim 9, wherein the additional constriction is intended to increase the load signal by 1.5 to 50 times.

15. A valve according to claim 9, wherein the additional constriction (S1) is a variable constriction having means for opening to a greater extent in response to increasing movement of the manoeuvering slide (B1).

16. A valve according to claim 9, wherein the load detecting constriction (S2) and the additional constriction (S1) have mutually different throttling effects.

* * * * *